US005447239A

United States Patent [19]

Tubbs, Jr.

[11] Patent Number: 5,447,239

[45] Date of Patent: Sep. 5, 1995

[54] GOLD PAN WITH FLUKES AND STRATIFIERS

[76] Inventor: George E. Tubbs, Jr., 21011 First Ave. S., Des Moines, Wash. 98198

[21] Appl. No.: 334,913

[22] Filed: Nov. 7, 1994

Related U.S. Application Data

[63] Continuation-in-part of Ser. No. 251,262, May 31, 1994, abandoned.

[51] Int. Cl.[6] ..... B03B 5/02

[52] U.S. Cl. ..... 209/434; 209/444; 209/451; 209/452; 209/506

[58] Field of Search ..... 209/434, 444, 451, 452, 209/505, 506, 508

[56] References Cited

U.S. PATENT DOCUMENTS

| | | | |
|---|---|---|---|
| 1,085,596 | 2/1914 | Earle | 209/452 |
| 4,267,036 | 5/1981 | Kleven | 209/444 |
| 4,406,783 | 9/1983 | Cleland | 209/444 |
| 5,160,035 | 11/1992 | McConnell | 209/506 X |
| 5,190,158 | 3/1993 | Remias | 209/506 X |
| 5,275,294 | 1/1994 | Krenzler | 209/434 |

*Primary Examiner*—David H. Bollinger
*Attorney, Agent, or Firm*—David L. Tingey

[57] ABSTRACT

A traditional gold pan 10 with a flat center base 11 with a spiral sidewall guide 20 from a vertical pan rim 13 to the pan base 11 incorporates a plurality of obtuse flukes 30 on the spiral extending into the spiral path to disrupt smooth flow of water and mineral matter. A spiralling guide is also provided on the base 11 leading to a cup 60 at the pan center. On the spiralling base guide 40 is a plurality of stratifiers extending from the guide base 40 into an outer spiral path. The pan is continuously rotated by an electric motor linked to the back of the by a belt and pulley.

19 Claims, 4 Drawing Sheets

GOLD PAN WITH FLUKES AND STRATIFIERS

This is a continuation-in-part of Ser. No. 08/251,262 filed in the United States 31 May 1994, now abandoned.

FIELD OF THE INVENTION

This invention relates generally to mineral washing pans and particularly to a gold pan with flukes and stratifiers used to mine gold dust and nuggets from rocks and sand with improved separation and collection of the heavy gold ore.

BACKGROUND OF THE INVENTION

It was discovered early that particles of gold could be found in sand and gravel of stream and river beds. It was also discovered that the large difference in specific gravity between gold and sand could be used to separate the precious particles from gangue, noting that gold has a specific gravity of between 14.5 and 19.3, and sand has only a specific gravity of 2.5.

To exploit the difference in specific gravity, a gold pan now common was devised comprising a frustum, or truncated conical cylinder, with mildly inclining sides closed on its smaller end by a flat bottom. Use involves placing an amount of mineral matter in the pan with an appropriate amount of water. To separate comparatively large pebbles from the finer mineral matter, an agitation action is usually first employed that raises large matter above the fine matter. The pan is then moved in a circular motion with the pan sidewall inclined slightly below horizontal to wash away light sand material. With the water moving on the pan sidewall without excess spillage, a swirling action washes the mineral matter with the large and lighter matter being washed off of the pan.

In further washing of the matter with gentle agitation, small particles are lifted into the water to create a temporary suspension of the particles with particles of high specific gravity quickly falling back down to the pan sidewall while low specific gravity particles remain in suspension. Thus, particles are separated by specific gravity as particles of low specific gravity are suspended, carried and washed away in water. The process does not achieve a well-defined single separation but a continuum of separation, so it is necessary to repeat the process, progressively separating heavier particles from lighter particles until only the very heaviest-remain.

Even the most skilled gold panner is not successful in recovering all of the gold mixed in the gangue using the traditional gold pan. Washing away low specific gravity particles also tends to wash away very small particles of high specific gravity with the sand. To improve the efficiency of the pan, various improvements have been attempted. One such improvement includes employing steps on the pan sidewall that create a pocket to capture the high specific gravity particles falling quickly out of suspension as the suspension flows laminarly over the steps. With the pan sidewall leaning slightly downwardly from horizontal, water progressively falls over succeeding steps and out of the pan carrying low specific gravity particles in suspension with it, as heavier particles fall out of suspension into the corners of the steps.

Another improvement now well-known is to have a spiral guide wall on the pan side wall instead of concentric steps. As the pan is rotated instead of moved in a customary circular or orbital motion, small, high specific gravity particles are urged inwardly into the pan center along the guide as low specific gravity particles are washed in suspension from one spiral step to another until they fall out of the pan. High specific gravity particles that may inadvertently fall with the slurry over a guide into a more outward spiral segment are simply reprocessed as they resume their migration toward the pan center from a more distant position in the spiral.

The goal with this type of pan then is to lift the low specific gravity particles into suspension, leaving large heavy particles on the pan and washing the remainder of the slurry over the guides or steps and out of the pan. Any improvement that assists in the process improves the efficiency of the pan.

SUMMARY OF THE INVENTION

The object of the present invention is to reliably improve the efficiency of a gold pan with a spiral guide to recover gold not previously separated in prior gold pans. Because the separation process is dependent on continuous mixing of the minerals so that high specific gravity particles progressively separate from lower specific gravity particles, improvement in the mixing process reaps a significant improvement in the efficiency of the panning process. The present invention teaches a plurality of angled flukes on the inside of a spiral guide progressing from a vertical pan rim, also having flukes, to a pan flat center base which flukes are employed in and interrupting the direction of the slurry movement to further mix the minerals up into the water.

Typically, the sidewall guide extends from the sidewall the same as or more than do the flukes so that the slurry tends to fall over or around the flukes before it falls over the spiral guide. The flukes taper angularly obtusely from the guide toward the direction of progression of the spiral guide toward the center base. The flukes do not extend to the next inward spiral of the guide so that mineral matter falls over a fluke and around end of a fluke between the fluke and the next inward loop of the spiral guide.

Because classification by specific gravity is of little effect until a general classification by size occurs, the flukes on the rim and on the sidewall spiral initially agitate the mineral mix as the matter falls past the flukes resulting in smaller matter falling to the spiral guide and rim with larger matter falling over the smaller matter, larger matter thereby rising to the surface of the mix as the mix repeatedly falls over the flukes. The larger matter is then easily washed out of the pan.

As the size classification becomes less pronounced, a classification by specific gravity begins to control. Small heavy particles are lifted momentarily into the water as the slurry immediately falls over or around the fluke but the quickly fall out of suspension back to the spiral path. Lighter particles remain in suspension slightly longer as the water washes these suspended particles over the guide. Light particles not washed over the guide are repeatedly subjected to this separation action at subsequent flukes until only the most dense matter remains in the spiral along the spiral rib eventually reaching the pan center planar area through this pumping and sweeping action.

A further classification occurs within the particles falling back to the same spiral path segment as the heavier particles less influenced by the water fall more quickly near the fluke and lighter materials are carried in the slurry a short distance past the fluke. Thus, as the heavy gold migrates along the guide, lighter minerals not remaining in suspension in the water passing over the guide to the next guide segment fall on top of the gold, achieving a layered separation by specific gravity within the remaining mix which is reemphasized at each fluke.

The spiral guide is constructed on the pan sidewall such that when the pan is leaned in the normal manner of gold panning, the sidewall is tipped below horizontal and the guide wall and vertical pan rim are inclined above horizontal. In this manner, the slurry with gangue in suspension gravitates out of the pan as the water moves outward from spiral guide to spiral guide eventually reaching the vertical pan rim where it captures the more dense materials, preventing them from escaping the pan.

With the spiral guide obliquely meeting and merging into the vertical pan rim, as the pan is rotated counter to the direction of the guide, the spiral guide lifts and carries the higher specific gravity materials captured at the rim back into progression up the spiral guide. Thus, the lighter materials only are allowed to escape the pan over the vertical pan rim while the particles falling out of suspension remain within the spiral guide and pan rim. In this way, the outside vertical rim collects the trappings of dense concentrate that may have been carried over the spiral guide with less dense material so the concentrate can be worked and reworked by the flukes in the spiral guide, further enhancing the efficiency of the pan in capturing virtually all of the gold concentrate presented to the pan.

The pan with flukes can also be used without water with slightly less efficiency. Separation without water is achieved through the described process of mineral matter being agitated and mixed as it falls past the flukes. The initial separation is again by size, with large matter falling over the sidewall guide and eventually out of the pan. Subsequent action at the flukes further classifies in a layering action with the more dense gold gravitating to the bottom of the mix at the joinder of the guide and the sidewall.

The result of the separation and classification on the sidewall spiral guide is that eventually only gold and black sand, which itself also contains gold, arrives at the pan base.

To further exploit the layering by density of the gold under the black sand, the gold pan is further enhanced with a spiraling base guide continuing the side wall guide onto the flat bottom base. As the pan continues to rotate, the black sand and gold are continuously lifted by the steeply inclined base guide from which the minerals continually fall to a new trailing position on the guide path, in this way progressing inwardly on the spiral but also causing a layering separation with the gold on the bottom covered by the black sand. To further separate the gold from remaining black sand, a plurality of vertical stratifiers is mounted radially on an outer side of the spiral base guide stopping short of the next outward spiral loop. These base stratifiers further assist the separation by allowing the bottom portion of the minerals, which tends to be gold, to pass under them while the upper portion is held back by the stratifiers. With a plurality of stratifiers on the base guide, typically at least 4 in the last two full revolutions of the spiral, the process is repeated until much of the black sand is removed.

A cup is provided in the pan base to collect the gold and remaining black sand. To further separate the gold from what black sand might still arrive in the cup, a plurality of agitator buttons, typically 4, are equally spaced inward of the circumference of the cup. As with the flukes on the sidewall spiral, the buttons serve to raise the gold-sand mixture in a temporary suspension, repeatedly allowing the heavier portion, or gold, to fall first out of suspension to the cup. Finally then, the gold originating with the matter introduced into the pan on the sidewall will quickly find its way to the cup bottom and be covered with a small layer of black sand which can be easily collected outside of the pan process.

To partially automate the pan process, the pan can be connected to an electric motor that continuously rotates the pan. A short cylinder on the bottom of the pan base is concentric with the cup bottom protruding from the outside of the pan at its center around the cup leaving an annular channel therebetween. A tube sized to match the channel is secured to a stand and inserts into the annular channel retained therein by a tight frictional fit. The matching tube is further provided with a pulley and a belt linking the pan to an electric motor mounted on the stand.

One skilled in the art will recognize the advantages taught by this invention and illustrated by the preferred embodiment presented. The specification and drawings are not intended to represent an exhaustive description of the invention. Obvious applications and extensions of the invention are intended to be within the spirit and scope of this invention.

DESCRIPTION OF THE PREFERRED EMBODIMENT

Figure 1:
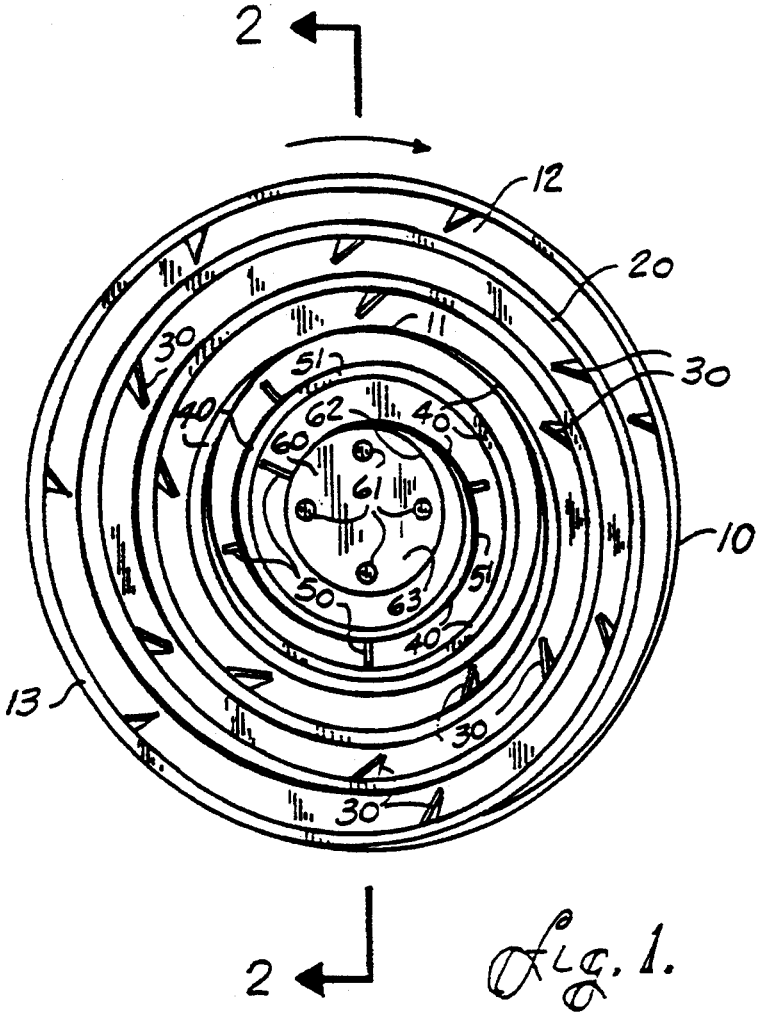
FIG. 1 is a front view of the gold pan with spiral guide, flukes, base guide, stratifiers, and center cup.
Figure 2:
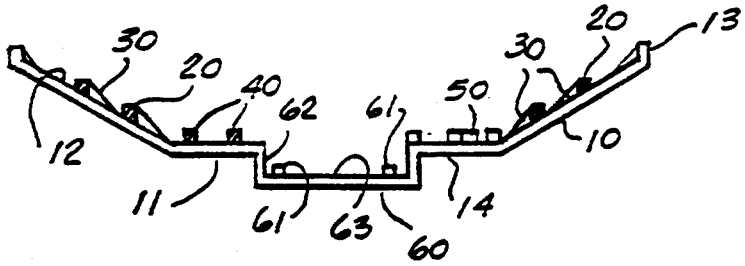
FIG. 2 is a cross-sectional view of the gold pan.
Figure 3:
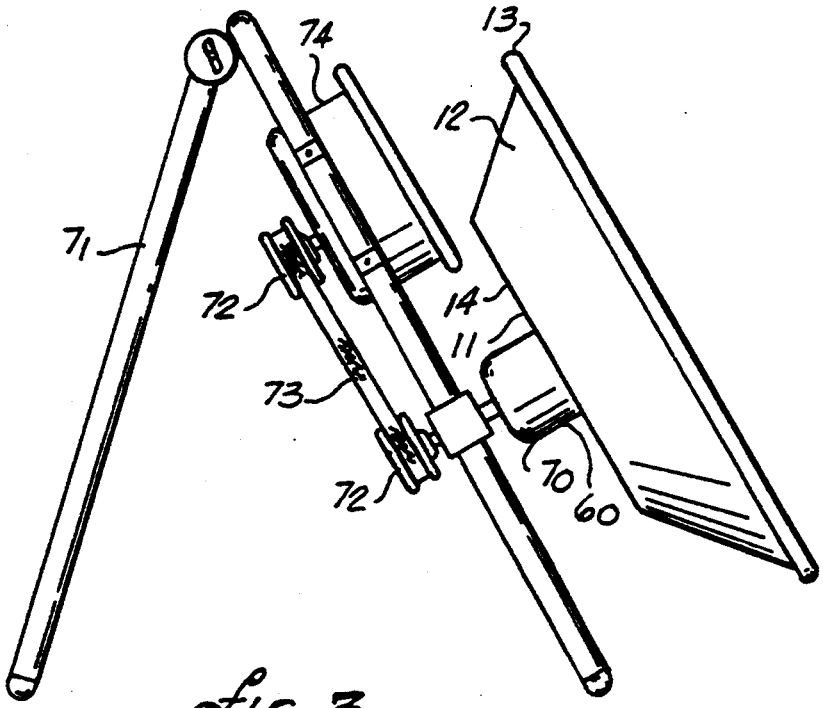
FIG. 3 is a side pictorial view of the pan in use mounted to a stand and an electrical motor.
Figure 4:
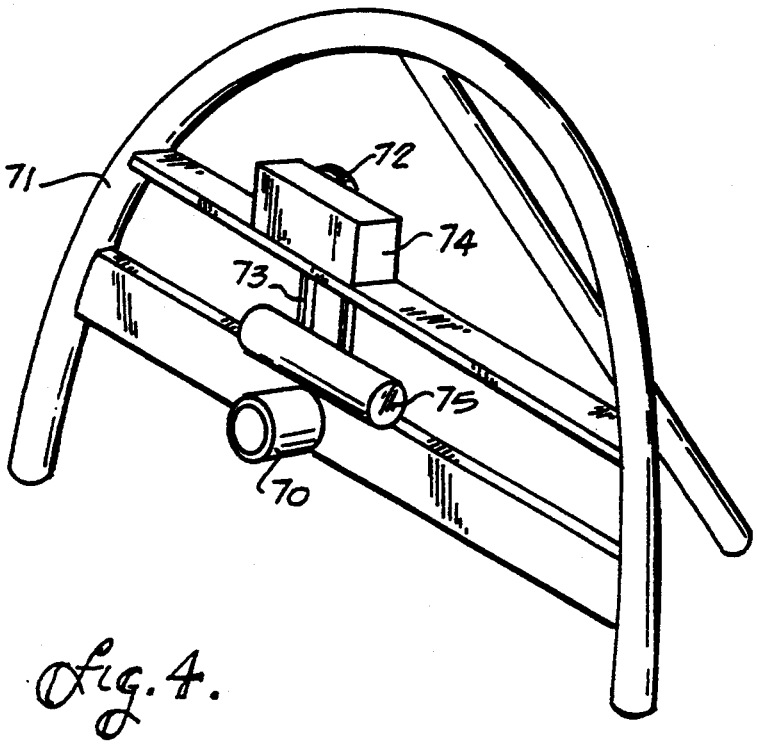
FIG. 4 is a front perspective view of the stand with motor and vibrator mounted thereon.
Figure 5:
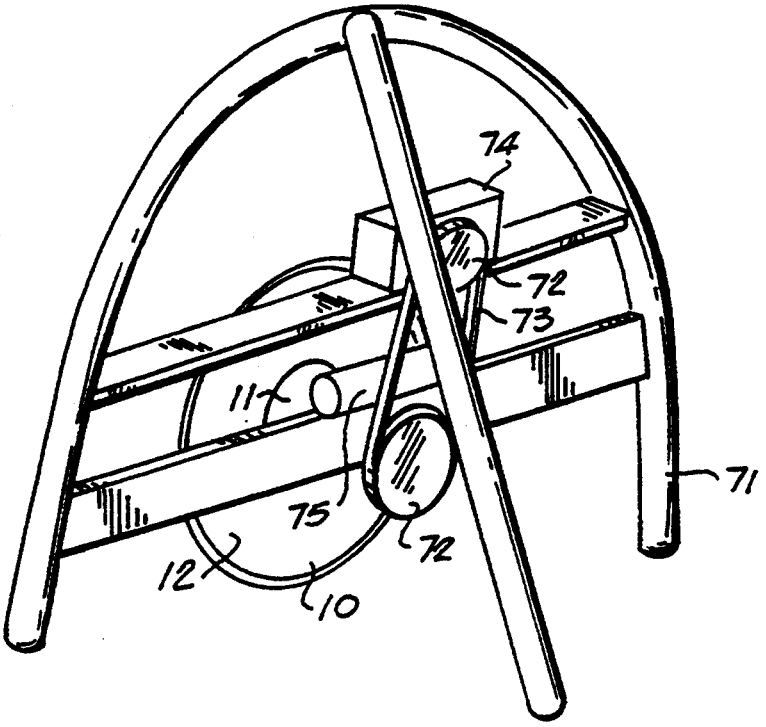
FIG. 5 is a rear perspective view of the gold pan stand.
Figure 6:
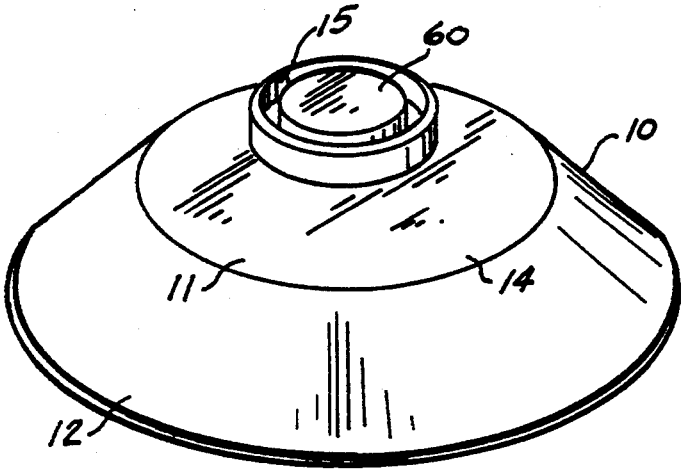
FIG. 6 is a rear perspective view of the pan bottom.
Figure 7:
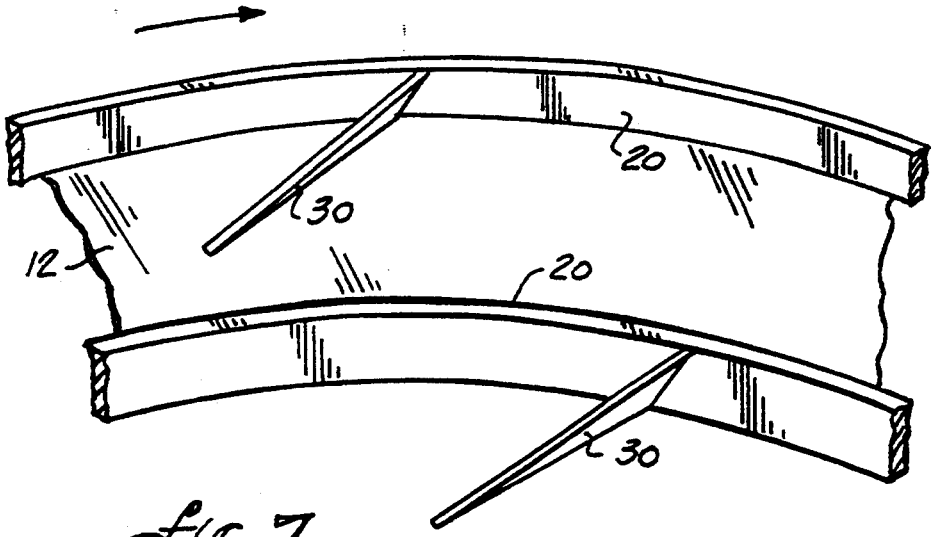
FIG. 7 is a perspective view of a section of the pan sidewall with spiral guide and fluke.
Figure 8:
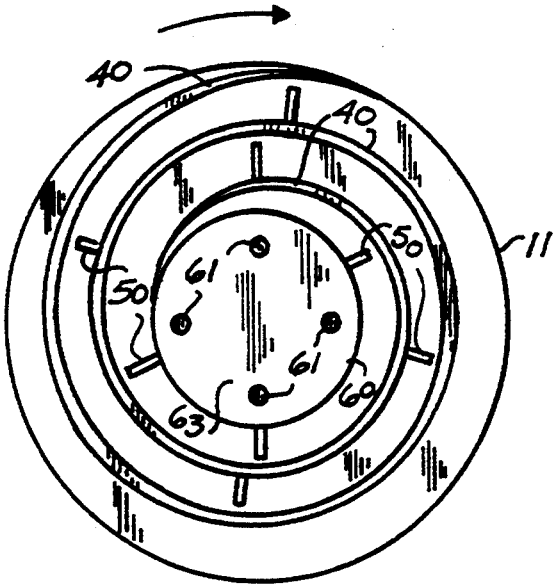
FIG. 8 is a front view of the pan base with base guides, stratifiers, and cup.

Referring to the figures, the present invention is directed to a traditional frustum gold pan 10 closed with a flat base 11 at its smaller end and with a sidewall 12 inclined approximately 45° from the pan base 11 to a pan rim 13 which extends upward, approximately normal to the plane of the pan circumference, from the pan sidewall near its edge. A sidewall guide 20 progresses in a spiral from the rim 13 to the base 11, extending from the pan sidewall 12 approximately orthogonal to the pan base 11.

On the sidewall 12 is a plurality of flukes 30 extending obtusely from the inside of the sidewall guide 20, typically at an angle of approximately 45° toward the direction of progression of the spiral sidewall guide 20 toward the base 11. The flukes 30 typically lean from the sidewall guide 20 away from the direction of spiral progression toward the base 11 to further channel smaller matter along the base of the fluke, separated by larger matter layered above in a mineral mix. The flukes 30 also generally have a decreasing height from the spiralling sidewall guide 20 to the sidewall 12, presenting a triangular obstruction to mineral progressing in pan along the spiralling guide 20 which allows larger particles to pass over the guide 20 while smaller particles are retained behind the fluke 30, thereby further differentiating and therefore classifying more dense matter at the bottom of a mineral mix from lighter matter on top.

A spiraling base guide 40 continues from the sidewall guide 20 onto the flat base 11. Further, on the base 11 is a plurality of vertical stratifiers 50 extending radially from an outer side 51 of the spiral base guide 40 but stopping short of the next outer spiral portion 40' of the base guide 40. At least 4 stratifiers 50 are typically located in the last two full revolutions of the base guide 40 in its spiral.

A cup 60 is provided in the center of the pan base 11 at the end 41 of the base guide 40. Within the cup 60 is a plurality of agitator buttons 61, typically ¼-inch diameter, on the cup bottom 63 equally spaced inward of the cup bottom circumference 62 and spaced slightly therefrom about ¼ inch.

From the underside of the pan 10 is a short cylinder extending from the pan bottom 14 around and concentric with the base cup 60 leaving an annular channel 15 therebetween. Removably inserted into the annular channel 15 with a frictional fit is a mounting tube 70 on a stand 71 that supports the pan 10 in operational position to which tube 70 is attached a pulley 72 and a belt 73 on the pulley 72 mechanically linking the pan 10 to an electric motor 74 also with a pulley 72 which rotationally drives the pan 10. A vibrator 75 is also mounted on the stand 71 to provide a continuous or temporarily actuated vibration transmitted through the stand 71 to the pan 10.

Having described the invention, what is claims is:

1. A traditional frustum gold pan closed with a flat base at its smaller end and a sidewall inclined from the pan base to a pan rim defining a concave pan front and a pan back, the improvement comprising a sidewall guide on the pan front with an inner side and an outer side in a spiral progression around the sidewall from the rim to the base, a plurality of flukes on the sidewall extending from the sidewall guide inner side stopping short of a next inward sidewall guide in its spiral progression to the base.

2. The gold pan of claim 1 wherein flukes extend from the sidewall guide inner side obtusely toward the direction of spiral progression toward the base.

3. The gold pan of claim 1 wherein the spiral guide extends from the sidewall farther than do the flukes.

4. The gold pan of claim 1 further comprising a spiraling base guide on the pan base, with an inner side, an outer side, and a spiral end, continuing the spirally sidewall guide onto the pan base near a base center.

5. The gold pan of claim 4 further comprising a plurality of vertical stratifiers extending radially from the outer side of the spiral base guide but stopping short of a next base guide outer spiral.

6. The gold pan of claim 5 further comprising at least 4 stratifiers located within two full revolutions of the base guide spiral near the spiral end.

7. The gold pan of claim 4 further comprising a cup in the pan base center at the end of the base guide and extending out of the pan back.

8. The gold pan of claim 7 further comprising within the cup a plurality of agitator buttons equally spaced inward of a cup circumference and spaced slightly therefrom.

9. The gold pan of claim 7 further comprising a stand to which the pan is mounted, and means for turning the pan in the stand.

10. The gold pan of claim 9 wherein the means for turning the pan in the stand comprises a short cylinder extending from the pan back around and concentric with the base cup forming an annular channel therebetween, a motor, a mounting tube frictionally fitting in the annular channel, a pulley on the mounting tube, a belt on the pulley mechanically linking the pan to the motor that rotationally drives the pan.

11. The gold pan of claim 1 further comprising a stand on which the pan is mounted, a vibrator on the stand transmitting vibration to the pan to agitate mineral matter therein.

12. The gold pan of claim 1 in which the flukes lean from the guide on the sidewall away from the direction of spiral progression toward the base.

13. The gold pan of claim 1 in which the flukes have a height that decreases from the spiralling sidewall guide to the sidewall.

14. The gold pan of claim 1 further comprising a pan rim extending upward from the pan sidewall near and approximately normal to the plane of the pan circumference, with the spiral guide meeting and obliquely merging into the pan rim.

15. The gold pan of claim 14 further comprising a plurality of flukes on the rim extending from a rim inner side.

16. A traditional frustum gold pan closed with a flat base at its smaller end and a sidewall inclined from the pan base to a pan rim defining a concave pan front and a pan back, the improvement comprising a cup in the pan base center extending out of the pan back, a spiraling base guide on the pan base, with an inner side and an outer side, ending at the cup in the pan base center, and at least four stratifiers located within two full revolutions of the ending of the spiraling base guide.

17. The gold pan of claim 16 in which each stratifier extends radially from the outer side of the spiral base guide but stops short of an outer spiral of the spiraling base guide.

18. The gold pan of claim 16 further comprising within the cup a plurality of agitator buttons equally spaced inward of a cup circumference and spaced slightly therefrom.

19. A traditional frustum gold pan closed with a flat base at its smaller end and a sidewall inclined from the pan base to a pan rim defining a concave pan front and a pan back, the improvement comprising a pan rim extending upward from the pan sidewall near and approximately normal to the plane of the pan circumference, with the spiral guide meeting and obliquely merging into the pan rim, a plurality of flukes on the rim extending from the rim inner side.

* * * * *